US006812630B2

(12) United States Patent
Hatta et al.

(10) Patent No.: US 6,812,630 B2
(45) Date of Patent: Nov. 2, 2004

(54) CATHODE-RAY TUBE

(75) Inventors: Shin-ichiro Hatta, Nara (JP); Ryuichi Murai, Toyonaka (JP); Hiroshi Iwamoto, Osaka (JP); Shigeo Nakatera, Hirakata (JP); Masaki Kawasaki, Toyonaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/182,261

(22) PCT Filed: Feb. 7, 2001

(86) PCT No.: PCT/JP01/00869

§ 371 (c)(1),
(2), (4) Date: Jul. 25, 2002

(87) PCT Pub. No.: WO01/59803

PCT Pub. Date: Aug. 16, 2001

(65) Prior Publication Data

US 2003/0001485 A1 Jan. 2, 2003

(30) Foreign Application Priority Data

Feb. 7, 2000 (JP) ..... 2000-028664

(51) Int. Cl.[7] ..... H01J 29/02
(52) U.S. Cl. ..... 313/407; 313/402
(58) Field of Search ..... 313/402, 403, 313/404, 405, 406, 407, 408, 421

(56) References Cited

U.S. PATENT DOCUMENTS 5,029,256 A * 7/1991 Tokita et al. ..... 313/407
5,214,349 A 5/1993 Sakata et al. ..... 313/407
6,528,933 B1 * 3/2003 Reyal ..... 313/407

FOREIGN PATENT DOCUMENTS

| | | |
|---|---|---|
| EP | 0 354 577 | 2/1990 |
| JP | 50-151059 | 4/1975 |
| JP | 03-159031 | 7/1991 |
| JP | 4-248227 | 3/1992 |
| JP | 10-003862 | 1/1998 |
| JP | 2922533 | 4/1999 |

OTHER PUBLICATIONS

"A Critical Comparison of Ferrites with Other Magnetic Materials", Magnetic Division of Spang and Company, copyright 2000.*

* cited by examiner

*Primary Examiner*—Ashok Patel
*Assistant Examiner*—Sharlene Leurig
(74) *Attorney, Agent, or Firm*—Parkhurst & Wendel, L.L.P.

(57) ABSTRACT

In the structure of the present invention, there can be provided a cathode ray tube in which deviation in the trajectory of the electron beams by the leakage magnetic field from the mask frame (1) is decreased by using a polygonal mask frame (1) in which the relative magnetic permeability of longer side members (31) out of two side members adjacent to each other at the joint portion of the mask frame (1) is the same as or larger than the relative magnetic permeability of the other side members (21). Thus, the significance of the present invention in industrial terms is large.

15 Claims, 8 Drawing Sheets

(a)

(b)

CATHODE-RAY TUBE

TECHNICAL FIELD

The present invention relates to a cathode ray tube used in a television set, a computer display monitor or the like.

BACKGROUND ART

When a cathode ray tube is placed in an external magnetic field such as terrestrial magnetism or the like, electrons ejected from an electron gun receive an additional Lorenz force generated by the action of the external magnetic field, so that the trajectory of electrons are deviated and landing points of the electrons are deviated from a normal location on the fluorescent material, as a result, electrons collide (referred to as mislanding). Furthermore, in the cathode ray tube having a shadow mask, the mislanding is also generated by the leaked magnetic flux generated with the magnetization of the mask frame for stretching and fixing the shadow mask.

Materials of conventional mask frames have a small relative magnetic permeability so that the materials are not easily magnetized. In many cases, such mask frame is formed of a material which is not easily brought back to zero magnetization state once it magnetized (a hard magnetic substance), so that the magnetic flux generated as the result of the magnetization of the material is easily leaked to the inside space of the cathode ray tube.

In order to reduce the deviation of the electron beams generated by the external magnetic field and the secondary leakage magnetic field or the like by the external magnetic field as described above, an inner magnetic shield is attached on the inside of the cathode ray tube to reduce the influence from the external magnetic field.

To summarize above description, the cathode ray tube having the conventional shadow mask described above has the following problem.

The conventional mask frame is not sufficiently magnetically shielded by the inner magnetic shield, so that the influence by the leakage magnetic field from the mask frame cannot be ignored.

DISCLOSURE OF THE INVENTION

A group of the present invention has been made in view of the present situation described above, and an object thereof is to provide a cathode ray tube in which the deviation in the trajectory of the electron beams resulted from the leakage magnetic field from the mask frame is reduced.

A group of the present invention has been made to attain the first object, and there is provided a cathode ray tube comprising a bulb whose inside maintained in vacuum, an electron gun provided inside of the bulb to eject electron beams, a fluorescent material which is provided on the inside wall of the bulb and which emits light when electron beams ejected from the electron gun are applied thereto, beam deflection means for deflecting the electron beams so as to scan the surface of the fluorescent material, an inner magnetic shield provided inside of the bulb for decreasing the deviation of the trajectory of the electron beams deflected by the beam deflection means in the external magnetic field, a shadow mask arranged in front of the inside surface of the fluorescent material and a polygon-shaped mask frame for fixing the shadow mask, the frame having a side member constituting each side and a joint portion for joining adjacent side members, wherein the adjacent side members in each joint portion satisfies the following condition;

$$\mu_{r,1} \geqq \mu_{r,s} \geqq 1$$

where $\mu_{r,1}$ represents a relative magnetic permeability of longer side member and $\mu_{r,s}$ represents a relative magnetic permeability of the other member.

When the concept of the magnetic circuit is introduced, it becomes possible to conveniently analyze the magnetic property in terms of characteristics. Consequently, the explanation below is given by using this concept. Since the mask frame and the shadow mask are normally formed of a magnetic substance, the mask frame, the shadow mask and the inner magnetic shield are considered as a magnetic resistance of the equivalent magnetic circuit. Here, the current in the electric circuit corresponds to the flow of the magnetic flux which flows through the virtual magnetic resistances. The current source in the equivalent electric circuit corresponds to the terrestrial magnetism which is an origin of the flow of the magnetic flux.

The smaller the relative magnetic permeability of the above-mentioned longer member becomes, the larger the magnetic resistance of the above-mentioned longer side member becomes. Consequently, the magnetic flux which flows through the other member having a small magnetic resistance cannot be perfectly absorbed with the result that the magnetic flux which flows through the virtual magnetic resistance of the vacuum space arranged in parallel increases. That is, a larger amount of the flow of the magnetic flux is leaked to the space inside of the mask frame. Consequently, the side member constituting the mask frame and having a longer length can decrease the magnetic field which is leaked to the space of the inside of the mask frame when the relative magnetic permeability is enlarged as compared with the short side member.

Here, the side member having a relative magnetic permeability of 1 or more refers to a non-magnetic substance and a magnetic substance. Furthermore, the magnetic substance is a generic name for a ferromagnetic substance including a hard magnetic substance and a soft magnetic substance, and an anti-ferromagnetic substance. In this specification, the non-magnetic substance refers to a substance having a relative permeability of 1, the hard magnetic substance refers to a substance having the relative permeability of bigger than one 1 and smaller than 100. The soft magnetic substance refers to a substance having a relative permeability of 100 or more.

Furthermore, the side member refers to a member having a part constituting one side of the mask frame. Consequently, the side member may not be a member having only a part constituting one side of the mask frame. Furthermore, the polygon-shaped mask frame refers not only to a frame having an external configuration forming a polygon but also to a frame or the like having a part projecting out of the frame.

Furthermore, the beam deflection means may be an electric field deflection means for deflecting the electron beams by the action of the electric field and the deflection means may be the magnetic field deflection means for deflecting electron beams by the action of the magnetic field. Generally, the magnetic field deviation means is used.

Since the display device such as a television set, a computer display or the like generally has a parallelogram-shaped display screen, preferably, the mask frame comprises a pair of short side members and a pair of long side members for stretching and fixing the shadow mask, and an overlapping surface of the pair of short side members and the pair of long side members is formed in a parallelogram-like configuration formed on the same planar surface. More preferably, the mask frame is a square-shaped or a rectangular-shaped mask frame. With the square-shaped or the rectangular-shaped mask frame, it becomes easy to manufacture a mechanically strong frame.

It is known that in the rectangular-shaped mask frame, the magnetic field is leaked from the end portion of the long side member and the joint portion of the long side member and the short side member. Since the magnetic flux from the end portion of the long side member is hardly leaked to the inside space of the inner magnetic shield, this magnetic flux does not affect the increase in the deviation in the beam so much. Furthermore, an influence of the leakage magnetic field from the end portion of the long side member becomes smaller with a reduction in a distance of the inner magnetic shield to the rectangular-shaped mask frame. However, the magnetic field is leaked to the inside space of the inner magnetic shield from the joint portion of the short side member and the long side member, which largely contributes to the deviation in the electron beams. The terrestrial magnetic field is absorbed by the open portion of the inner magnetic shield and flows to the mask frame magnetizing the mask frame. When the relative magnetic permeability of the short side member is different from the relative magnetic permeability of the long side member, so that if a considerable difference is present in the magnetic resistances of the two, a larger amount of magnetic flux flows to the side member having a smaller magnetic resistance. On the other hand, only a small amount of magnetic flux can flow through the side member having a high magnetic resistance. Consequently, the flow of the magnetic flux will inevitably flow out at the joint portion of the short side member and the long side member. Consequently, when the relative magnetic permeability of the long side member is set to be larger than the relative magnetic permeability of the short side member, the flow of the magnetic flux in the short side member flows into the long side member, so that the leakage of the magnetic field into the inside space of the inner magnetic shield can be decreased.

In the case of the parallelogram-shaped mask frame in which the end of the pair of the long side members in the longitudinal direction is projected in an outward direction from the joint portion while the end of the short side member in the longitudinal direction is not projected in an outward direction, a strong joint by welding can be made possible with the result that the frame having an extremely strong mechanic strength can be manufactured. Besides, the flow of the magnetic flux is concentrated on the end portion of the long side member which generally has a high relative magnetic permeability. However, the end portion is distanced from the mask frame, so that the influence of the leakage magnetic field from the end portion inside of the mask frame becomes small.

For a pair of the short side members and a pair of the long side members, the hard magnetic substance and the soft magnetic substance, the hard magnetic substance and the hard magnetic substance, the non-magnetic substance and the soft magnetic substance, the non-magnetic substance and the hard magnetic substance and the non-magnetic substance and the non-magnetic substance can be used.

When the relative magnetic permeability of the pair of the short side members is ⅓ or less of the relative magnetic permeability of the pair of long side members, the leakage of the magnetic field to the inside of the mask frame can be effectively decreased. Furthermore, in the similar manner, when the product of the relative magnetic permeability of the pair of short side members and the cross sectional area of the short side members in the joint portion is ⅓ or less of the product of the relative magnetic permeability of the long side members and the cross sectional area of the long side member in the joint portion, the leakage of the magnetic field into the inside space of the mask frame can be decreased.

In the case where the soft magnetic substance is used as the long side member, it is possible to form a mask frame which has a mechanical strength required for stretching and fixing the shadow mask and which decreases the leakage magnetic field inside of the mask frame when the long side member is a soft magnetic substance having a relative magnetic permeability of 200 or less.

Figure 1:
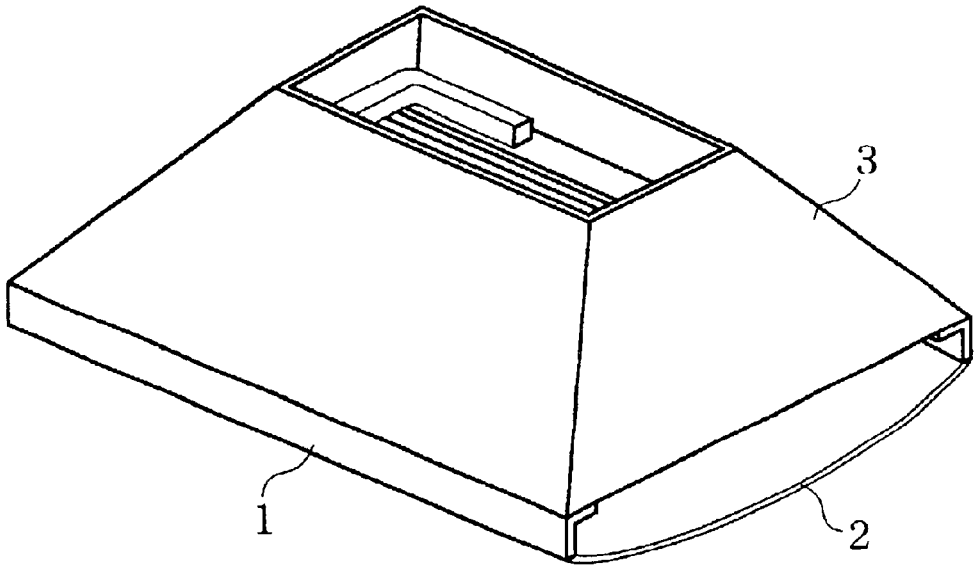
FIG. 1 is a perspective view showing a magnetic structure including a mask frame for explaining Example 1.

BEST MODE FOR CARRYING OUT THE INVENTION (1) Preferred Embodiments in the Invention Group Hereinafter, the first invention group of the present invention will be explained by referring to the drawings.

EMBODIMENT 1

Figure 6:
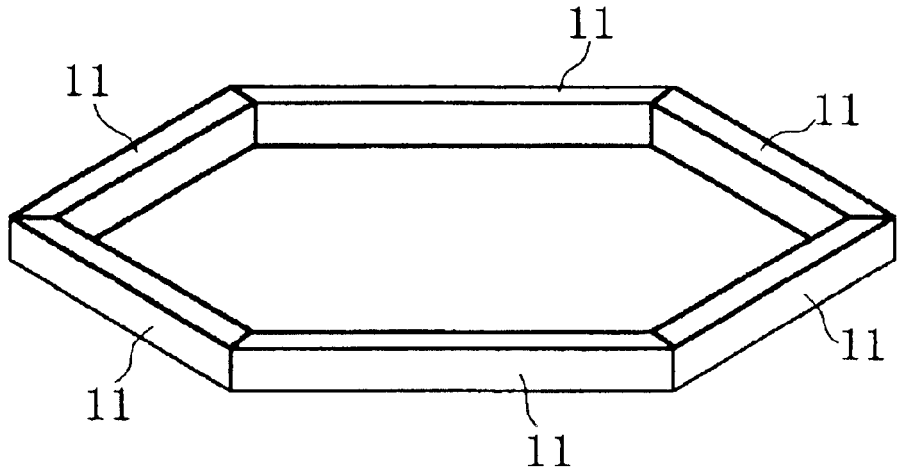
FIGS. 6A and 6B are perspective views for explaining examples of structures for the polygon-shaped mask frame.
Figure 6:
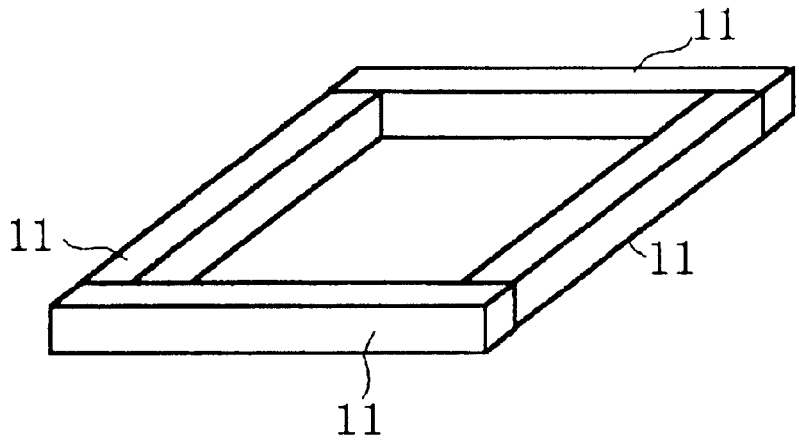

In Embodiment 1, a configuration of the mask frame will be explained by referring to FIGS. 6 through 8.

As the mask frame, it is preferable to form a polygon-shaped frame which comprises three or more side members 11. Consequently, the exterior configuration of the mask frame may be such that a polygonal configuration may be formed as shown in FIGS. 6A and 6B, or may be a polygonal configuration having a part of the side member projecting in an outward direction of the mask frame as shown in FIG. 7. A hexagonal-shaped mask frame is shown in FIG. 6A, and a quadrangle-shaped mask frame is shown in FIG. 6B.

Figure 7:
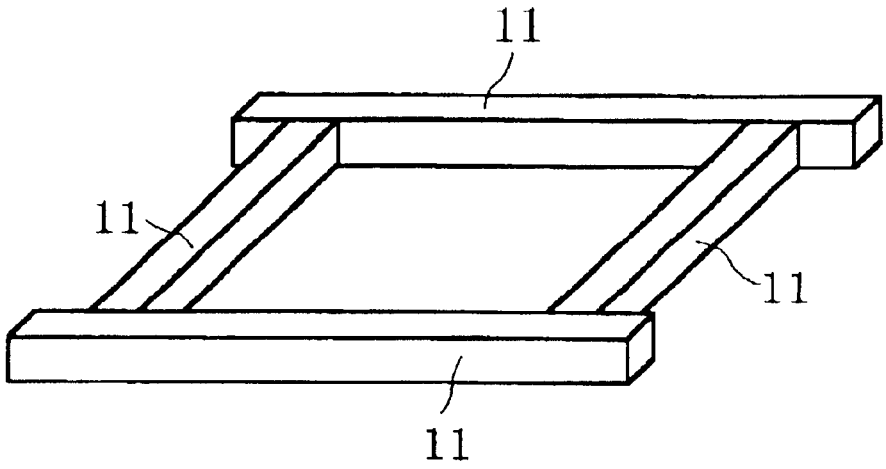
FIG. 7 is a perspective view for explaining example of structure for the planar type mask frame.
Figure 8A:
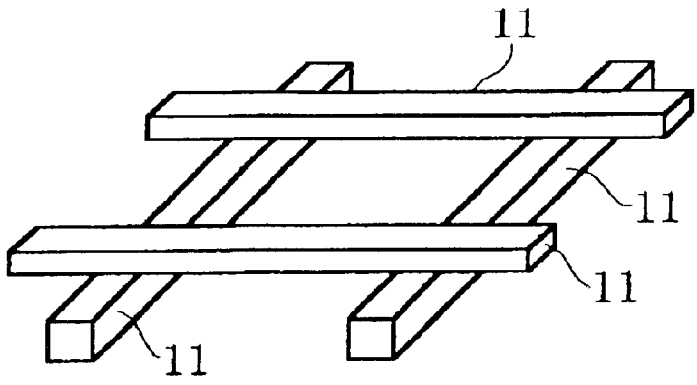
FIGS. 8A through 8C are perspective views for explaining examples of structures for the three dimensions type mask frame.
Figure 8B:
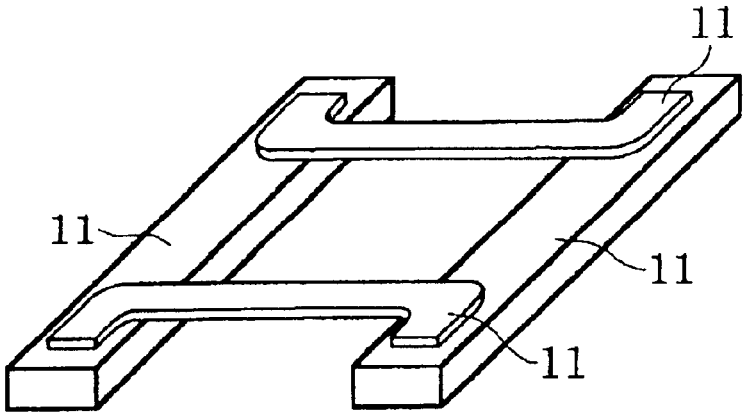
Figure 8C:
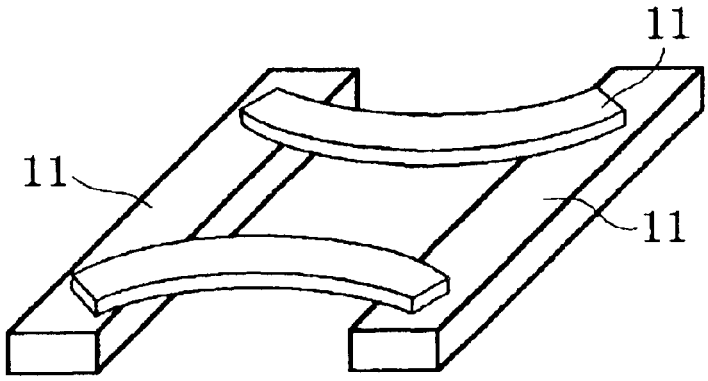

Furthermore, each side member 11 may be joined in a planar configuration as shown in FIGS. 6A, 6B and 7. Each side member 11 may be joined in three dimensional configuration as shown in FIGS. 8A through 8C.

Each side member may be an L-shaped material, H-shaped material, etc. in addition to the quadrangle-shaped material. Furthermore, each side member may be formed of a straight-line member or may be a partially crooked member or a wholly curved member. Furthermore, it is not required that each member have the same cross sectional shape. The mask frame having straight-line side members is shown in FIG. 8A, and the mask frame having the partially crooked side members is shown in FIG. 8B, and the mask frame having the wholly curbed side members is shown in FIG. 8C.

The joint portion of any of arbitrary two members may be joined by using fixing parts such as screws, an adhesive agent or the like, and may be strongly joined by welding or the like.

In the case of the display device such as a television set, a computer or the like, preferably, a parallelogram-shaped mask frame including a square shape and a rectangle shape is formed. More preferably, a square-shaped or a rectangular-shaped mask frame is formed. In the rectangular-shaped mask frame, the long side member is preferably formed in a configuration projecting toward the outside of the frame. Furthermore, generally, the shadow mask is stretched and fixed to the mask frame, so that the mask frame is preferable which has a joint portion strongly joined by welding or the like.

EMBODIMENT 2

In Embodiment 2, there will be explained the selection of the material of the pair of short side members and the pair of long side members in the case of a rectangular-shaped mask frame in which the pair of short side members and the pair of long side members are joined by welding. In the selection of the various materials for the pair of short side members and the pair of long side members, it is necessary to pay attention to the fact that the pair of short side members and the pair of long side members have a relative magnetic permeability of 1 or more respectively while the relative magnetic permeability of the pair of short side members is the same as or less than the relative magnetic permeability of the pair of long side members.

It is possible to use a magnetic substance for the pair of the short side members and the pair of long side members. Here, the magnetic substance includes a ferromagnetic substance and an anti-ferromagnetic substance.

Preferably, the mask frame may be such that the hard magnetic substance is used for the pair of the short side members while the soft magnetic substance is used for the pair of long side members, or the mask frame may be such that the first hard magnetic substance is used for the pair of short side members while the second hard magnetic substance, which has a relative magnetic permeability larger than the first magnetic substance, is used for the pair of long side members. In the case where the hard magnetic substance is used for the pair of short side members as described above, more preferably, the relative magnetic permeability of the pair of short side members is ⅓ or less of the pair of long side members. In the case where the soft magnetic substance is used for the long side members, the soft magnetic substance is preferably used which has a relative magnetic permeability of 200 or less. In addition, the first hard magnetic substance and the second hard magnetic substance may have the same relative magnetic permeability.

When the mask frame is used in general display device, an alloy which includes iron as a main component is preferably used for the pair of short side members and the pair of long side members in consideration of the mechanical strength aspect and the cost aspect.

Furthermore, the mask frame may be such that the non-magnetic substance is used for the pair of the short side members while the soft magnetic substance, the hard magnetic substance or the non-magnetic substance is used for the pair of long side members.

Still furthermore, when the strength required for stretching the shadow mask is low, the mask frame may be such that the soft magnetic substance is used both for the pair of short side members and the pair of long side members. In the case where the soft magnetic substance is used for the long side members, the soft magnetic substance is preferably used which has a relative magnetic permeability of 200 or less.

EXAMPLE 1

Figure 2:
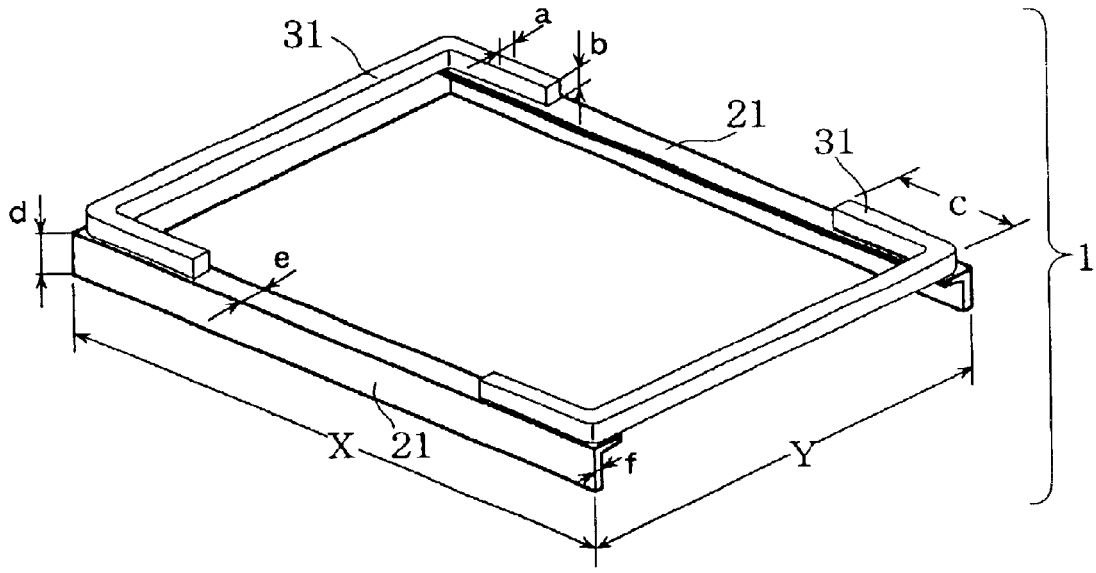
FIG. 2 is a perspective view showing a mask frame for explaining example 1.
Figure 3:
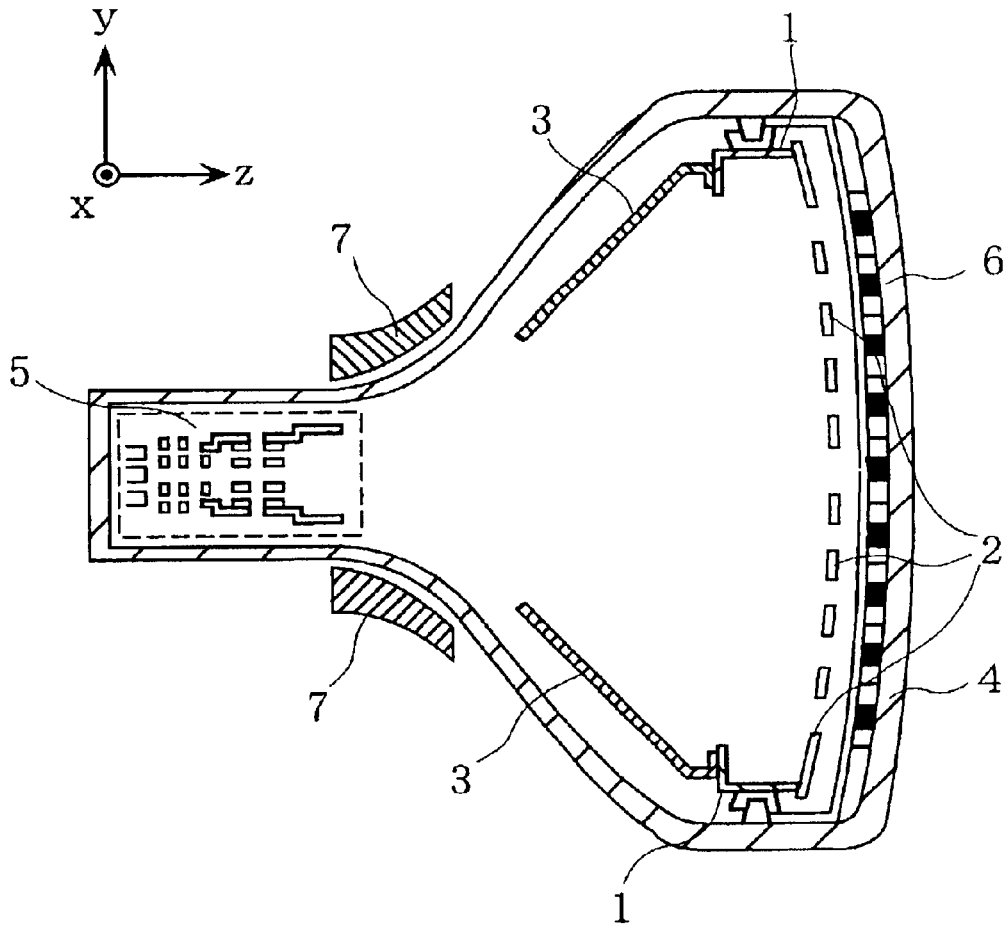
FIG. 3 is a conceptual structure view showing a cathode ray tube having a mask frame on which a shadow mask is stretched.

Except for the mask frame 1 shown in FIG. 2, a cathode ray tube for use in a 25-inch display device comprising a shadow mask stretched type mask frame 1, a shadow mask 2, an inner magnetic shield 3, a bulb 4, an electron gun 5, a fluorescent material 6 and a deflection yoke 7, as shown in FIG. 3, is manufactured in accordance with the prior art. A magnetic structure including the mask frame 1, the shadow mask 2, and the inner magnetic shield 3 is shown in FIG. 1.

A curved quadrangle-shaped material is used for a pair of short side members 31 (a=15 mm, b=15 mm, c=105 mm) and an L-shaped straight-line material is used for a pair of long side members (d=29 mm, e=29 mm, f=5 mm). The pair of long side members 21 and the pair of short side members 31 are joined (X=476 mm, Y=356 mm) by welding so as to project the end of the pair of long side members in the longitudinal direction in an outward direction and to make the overlapping surface of the pair of short side members and the pair of long side members be on the same surface.

In Example 1, the mask frame A1 is formed by using iron-chromium-molybdenum alloy (hereinafter referred to as Fe—Cr—Mo alloy) having a relative magnetic permeability of 90 for the pair of short side members 31 and Fe—Cr—Mo alloy having a relative magnetic permeability of 140 for the pair of long side members 21. The members are joined by welding.

Figure 4:
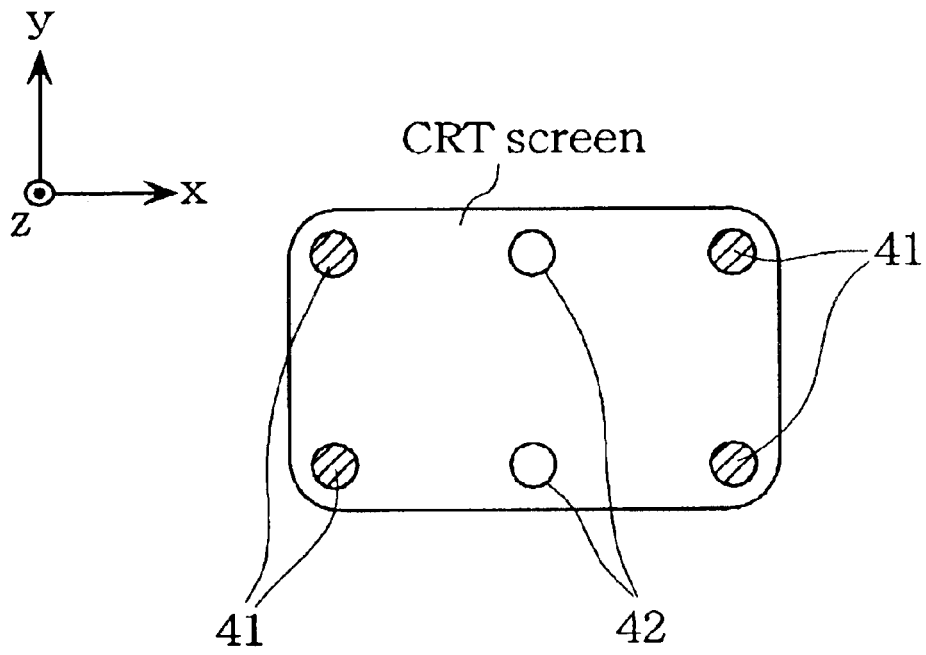
FIG. 4 is a plane view for explaining a deviation measurement method of electron beams.
Figure 5:
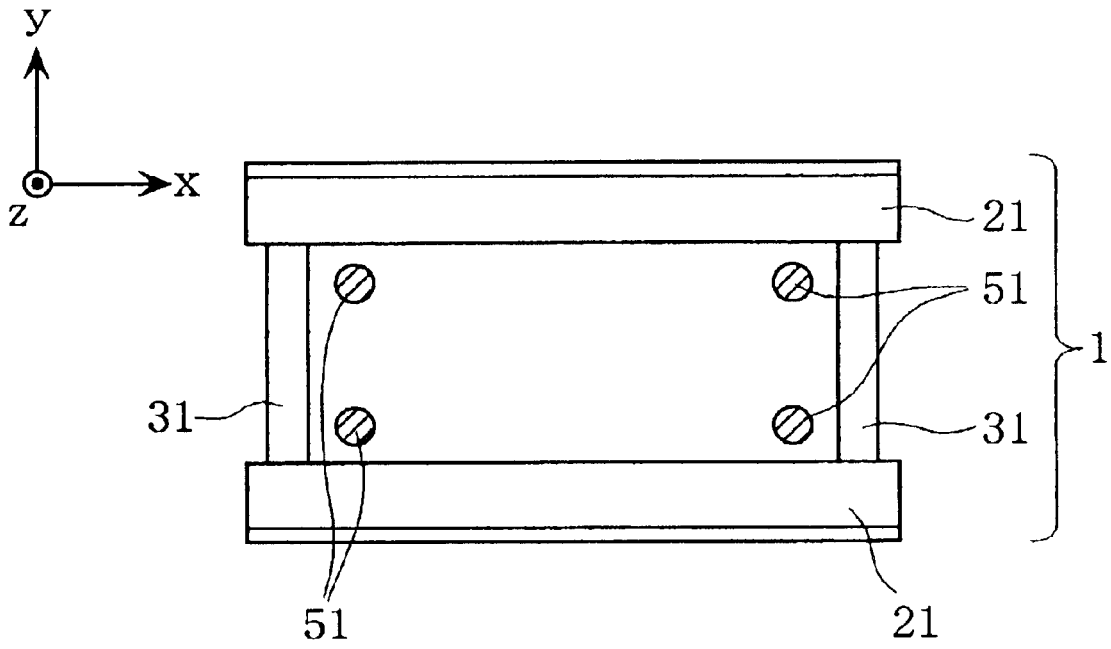
FIG. 5 is a plane view showing a part for measuring leakage magnetic field inside of the mask frame.

There will be explained a method for measuring the deviation of the electron beams by referring to FIGS. 4 to 5. In the beginning, the mask frame is demagnetized in an experiment chamber which is magnetically shielded. Next, the deviation of the beam at four corner portions 41 is measured by applying a static magnetic field of 24 A/m in the positive direction of X-axis and a static magnetic field of 28 A/m in the positive direction of Y-axis. Thus, the average value is taken to be the first deviation measurement value. Next, after the demagnetization of the magnetic structure, the static magnetic field of 28 A/m in the positive direction of Y-axis and the static magnetic field of 24 A/m in the positive direction of Z-axis are applied to measure the deviation of the beam at the four corner portions 41 and the deviation of the beams at two middle point parts 42 on the upper end and the lower end of the middle point of the long side of the screen. Then, the average of the measurement values at the four corner portions 41 are set as the second deviation measurement value, and the average value of the measurement value at the two middle point parts 42 is set as the third deviation measurement value. In the following explanation, the deviation of the electron beams is represented by δ for simplicity (the first deviation measurement value, the second deviation measurement value, and the third deviation measurement value). For example, the deviation is abbreviated as δ (20 μm, 45 μm, and 40 μm).

Furthermore, when the leakage magnetic field inside of the mask frame is strong, the deviation of electron beams becomes large. When the leakage magnetic field is weak, the deviation of the electron beams becomes small. Consequently, it is possible to determine the scale of the deviation of the electron beams by measuring only the leakage magnetic field. Thus, in part of the embodiments described below, only the magnetic field is measured by using a Gauss meter.

When a method for measuring the deviation of the electron beams is applied to the mask frame A1, the deviation of electron beams is δ (19 μm, 38 μm, and 32 μm). Furthermore, when the magnetic field is measured in the vicinity of the joint portion (hereinafter referred to as a frame corner portion 51) inside of the mask frame by using the Gauss meter, 40 A/m is given.

In conventional mask frames, generally the soft magnetic substance ($\mu_r$=127) of Fe—Cr—Mo alloy is used for the pair of short side members 31 while the hard magnetic substance ($\mu_r$=69) of Fe—Cr—Mo alloy is used for the pair of long side members 21. When a mask frame X which is different from the mask frame A1 only in material was manufactured and the method for measuring the deviation of the electron beams was applied, the deviation of the beams was δ (20 μm, 45 μm and 40 μm), and the leakage magnetic field at the frame corner portion 51 was about 160 A/m. The leakage magnetic field in this case is approximately three times the terrestrial magnetism.

When the case in which the mask frame A1 is used is compared with the case in which the mask frame X is used, it can be seen that the beam mislanding by the leakage magnetic field can be decreased.

EXAMPLE 2

In Example 2, a mask frame B is manufactured in the same manner as Example 1 except for the fact that the hard magnetic substance ($\mu_r$=69) of the Fe—Cr—Mo alloy is used for the pair of short side members 31 and hard magnetic substance ($\mu_r$=71) of the Fe—Cr—Mo alloy is used for the pair of long side members 21.

When the leakage magnetic field of the frame corner portion in this mask frame B was measured, the leakage magnetic field was 55 A/m. Consequently, when the case in which the mask frame B is used is compared with the case in which the mask frame X is used, it can be seen that the beam mislanding by the leakage magnetic field can be decreased.

EXAMPLE 3

In Example 3, a mask frame C is manufactured in the same manner as Example 1 except for the fact that the hard magnetic substance ($\mu_r$=40) of the Fe—Cr—Mo alloy is used for the pair of short side members 31 and the soft magnetic substance ($\mu_r$=140) of the Fe—Cr—Mo alloy is used for the pair of long side members 21.

When the leakage magnetic field of the frame corner portion in this mask frame C was measured, the leakage magnetic field was 36 A/m. Consequently, when the case in which the mask frame C is used is compared with the case in which the mask frame X is used, it can be seen that the beam mislanding by the leakage magnetic field can be decreased.

EXAMPLE 4

In Example 4, a cathode ray tube is manufactured in the same manner as Example 1 except for the fact that a mask frame D is formed by using stainless steel which is non-magnetic substance ($\mu_r$=1) for the pair of short side members 31 and the pair of long side members 21.

When the method for measuring the deviation of the electron beams was applied to the mask frame D, the deviation of the electron beams was δ (20 μm, 35 μm and 31 μm). Consequently, when the case in which the mask frame D is used is compared with the case in which the mask frame X is used, it can be seen that the beam mislanding by the leakage magnetic field is decreased.

INDUSTRIAL APPLICABILITY

As has been explained above, according to the structure of the present invention, a cathode ray tube can be provided wherein a deviation in the trajectory of the electron beams by the leakage magnetic field from the mask frame is decreased by using a polygon-shaped mask frame, wherein the relative magnetic permeability of the longer side member out of the two side members adjacent to each other at the joint portion of the mask frame is the same as or larger than the relative magnetic permeability of the other member. Consequently, the industrial significance of the present invention is large.

What is claimed is:

1. A cathode ray tube comprising:

a bulb whose inside volume is maintained in vacuum;

an electron gun located inside of said bulb for ejecting electron beams;

a fluorescent material located on an inside wall of said bulb, for emitting light when electron beams ejected from said electron gun are applied thereto;

beam deflection means for deflecting such electron beams to scan the surface of said fluorescent material;

an inner magnetic shield located inside said bulb for decreasing the deviation of the trajectory of electron beams deflected by the beam deflection means in an external magnetic field;

a shadow mask arranged in front of an inside surface of said fluorescent material; and a polygon-shaped mask frame for fixing said shadow mask, the frame comprising a side member for each side of said frame and a joint portion for joining adjacent side members, wherein the adjacent side members connected by each joint portion satisfy the following condition:

$$\mu_{r,1}>\mu_{r,s}>1$$

where $\mu_{r,1}$ represents a relative magnetic permeability of a longer side member and $\mu_{r,s}$ represents a relative magnetic permeability of the other member.

2. The cathode ray tube according to claim 1, wherein said mask frame comprises a pair of short side members and a pair of long side members for stretching and fixing said shadow mask and said mask frame comprises a parallelogram-shaped mask frame in which overlapping surfaces of said pair of short side members and said pair of long side members are located on the same plane.

3. The cathode ray tube according to claim 2, wherein said pair of long side members in the longitudinal direction of the mask frame has ends projecting in an outward direction from the joint portion, and said short side members do not have ends projecting in an outward direction from the joint portion.

4. The cathode ray tube according to claim 3, wherein said pair of short side members comprises a first hard magnetic substance.

5. The cathode ray tube according to claim 4, wherein said pair of long side members comprises a soft magnetic substance.

6. The cathode tube ray tube according to claim 5, wherein the relative magnetic permeability of said pair of short side members is not more than ⅓ of the relative magnetic permeability of said pair of long side members.

7. The cathode ray according to claim 6, wherein the relative magnetic permeability of said soft magnetic substance is not more than 200.

8. The cathode ray tube according to claim 5, wherein the product of the relative magnetic permeability of said pair of short side members and the cross sectional area of said short side members in said joint portion is not more than ⅓ times the product of the relative magnetic permeability of said long side members and the cross sectional area of said long side member in said joint portion.

9. The cathode ray tube according to claim 8, wherein the relative magnetic permeability of said pair of long side members is not more than 200.

10. The cathode ray tube according to claim 4, wherein said pair of long side members comprises a second hard magnetic substance.

11. The cathode ray tube according to claim 10, wherein the relative magnetic permeability of said pair of short side members is not more than ⅓ the relative magnetic permeability of said pair of long side members.

12. The cathode ray tube according to claim 4, wherein the product of the relative magnetic permeability of said pair of short side members and the cross sectional area of said short side members in said joint portion is not more than ⅓ the product of the relative magnetic permeability of said pair of long side members and the cross sectional area of said long side members in said joint portion.

13. The cathode ray tube according to claim 2, wherein said pair of short side members comprises a magnetic substance and said pair of long side members comprises a hard magnetic substance.

14. The cathode ray tube according to claim 2, wherein said pair of short side members comprises a magnetic substance and said pair of long side members comprises a hard magnetic substance.

15. The cathode ray tube according to claim 14, wherein the relative magnetic permeability of said soft magnetic substance is not more than 200.

* * * * *

UNITED STATES PATENT AND TRADEMARK OFFICE

CERTIFICATE OF CORRECTION

PATENT NO. : 6,812,630 B2
DATED : November 2, 2004
INVENTOR(S) : Shin-ichiro Hatta et al.

It is certified that error appears in the above-identified patent and that said Letters Patent is hereby corrected as shown below:

Column 10,
Line 15, change “hard” to -- soft --.

Signed and Sealed this

Nineteenth Day of April, 2005

JON W. DUDAS
*Director of the United States Patent and Trademark Office*